United States Patent [19]

Henderson

[11] Patent Number: 4,648,525

[45] Date of Patent: Mar. 10, 1987

[54] FOLD-UP INSULATED BEVERAGE CONTAINER HOLDER WITH A STABILIZING SUPPORT BASE

[76] Inventor: Scott R. Henderson, 5025 Eagle Pass, Plano, Tex. 75023

[21] Appl. No.: 783,096

[22] Filed: Oct. 2, 1985

[51] Int. Cl.[4] ..... B32B 3/26

[52] U.S. Cl. ..... 220/85 H; 215/13 R; 215/100.5

[58] Field of Search ..... 220/85 H, 449, 3.1, 220/DIG. 9; 229/90, 91; 215/12 A, 13 R, 100.5; 150/52

[56] References Cited

U.S. PATENT DOCUMENTS

| | | | |
|---|---|---|---|
| 1,917,953 | 7/1933 | Davis | 215/100.5 |
| 2,263,122 | 11/1941 | DeHaven | 215/100.5 |
| 4,181,765 | 1/1980 | Harmony | 215/13 R X |
| 4,197,890 | 4/1980 | Simko | 215/13 R X |
| 4,293,015 | 10/1981 | McGough | 220/449 X |
| 4,401,245 | 8/1983 | Zills | 215/13 R X |
| 4,510,665 | 4/1985 | Scheurer | 215/100.5 X |
| 4,540,611 | 9/1985 | Henderson | 220/85 H X |

*Primary Examiner*—Steven M. Pollard
*Attorney, Agent, or Firm*—Warren H. Kintzinger

[57] ABSTRACT

A one piece beverage insulator holder in the form of a beverage container holder with an open top and an expanded area support base that is die cut from a sheet of insulative foam either open cell or closed cell laminated with a surface vinyl film. The one piece beverage insulator die cut pattern is in the form of a main body portion that, when the ends are tape fastened together and a can is being held thereby, assumes the shape of a cylinder. There is a bottom projection from an edge of the main body portion that has an interconnect shank having two opposite side cutouts extending into the main body portion. The bottom projection has a generally rounded portion, approximately the size and shape of a can bottom held in the holder, with a flat edge surface on the opposite side from the interconnect shank. Toward the outer edges of the main body portion there are two additional cutouts duplicating the two shank opposite side cutouts leaving two mirror image tabs that as the body portion ends are taped together the two tabs are taped together and to the flat edge surface by an extension of the tape used to tape the body portion ends together. Thus there is provided a collapsible can holder having a bottom that is drawn up within the space of the body portion such that the bottom edges thereof are generally coplanar with the bottom surface of the holder bottom to provide increased stabilized support from supporting surfaces the can holding insulated beverage holder may be placed on.

10 Claims, 10 Drawing Figures

FOLD-UP INSULATED BEVERAGE CONTAINER HOLDER WITH A STABILIZING SUPPORT BASE

Figure 1:
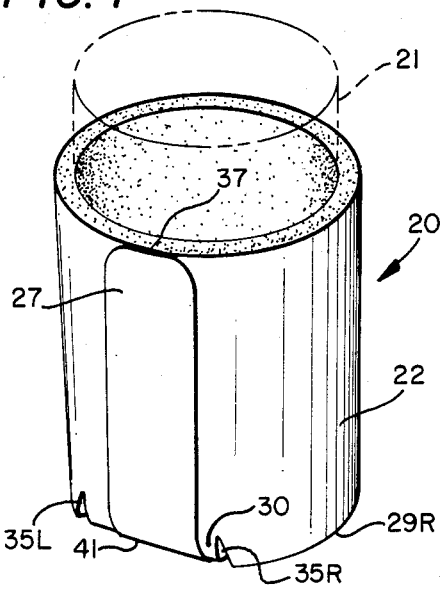

This invention relates in general to beverage insulators, and more particularly, to a fold-up insulated beverage container holder with a bottom drawn to within the profile of the holder main body portion when holding a can and with the bottom edge thereof providing more stabilized support in a unit collapsible to a folded state.

Beverage insulators come in many configurations and sizes made of many different insulative materials and many are quite expensive. Many such beverage insulators are made of relatively rigid insulative materials in the form of cup like receptacles receiving and holding beverage containers. Such beverage insulators such as stiff foamed plastic obviously can not collapse as this would be destructive of the molded beverage insulator form. Wrap around beverage insulators, while good and convenient for use in many instances, require a fastening device such as Velcro in order that the insulator be adaptable to some degree to different diameter beverage containers and be reuseable time after time. Further, wrap around beverage insulators must constantly be grasped firmly on the beverage container, since, not having a bottom, a beverage container can slip through and out the bottom not only losing the drink but creating a spilled mess. Still further, many of the beverage insulators having bottoms do not provide stable support for the beverage container when placed on a supporting surface. The advertiser using beverage insulators as an advertising media wants the insulators to be liked by the user, as an adverse feeling with respect thereto could reflect on the advertiser.

It is therefore a principal object of this invention to provide a beverage insulator generally acceptable to the using public, easy and convenient in use and foldable to a flat convenient store state when not in use holding a beverage container.

Another object is to provide such a beverage can insulator that gives improved support stability for the insulator and the beverage can when placed on a surface.

A further object is to provide an efficient reuseable beverage insulator that is economically produced and affordable to the public.

Another object is to provide such a beverage insulator as an excellent advertising media product.

Still another object is to make the holding of beverage containers, hot or cold, more secure and safe without constantly having to firmly grasp an insulator on the beverage container being held.

Features of the invention useful in accomplishing the above objects include, in a fold-up insulated beverage container holder with a stabilizing support base, a one piece beverage insulator holder in the form of a beverage container holder with an open top and an expanded area support base that is die cut from a sheet of insulative foam either open cell or closed cell laminated with a surface vinyl film. The one piece beverage insulator die cut pattern is in the form of a main body portion that, when the ends are tape fastened together and a can is being held thereby, assumes the shape of a cylinder. There is a bottom projection from an edge of the main body portion that has an interconnect shank having two opposite side cutouts extending into the main body portion. The bottom projection has a generally rounded portion, approximately the size and shape of a can bottom held in the holder, with a flat edge surface on the opposite side from the interconnect shank. Toward the outer edges of the main body portion there are two additional cutouts duplicating the two shank opposite side cutouts leaving two mirror image tabs that as the body portion ends are taped together the two tabs are taped together and to the flat edge surface by an extension of the tape used to tape the body portion ends together. Thus there is provided a collapsible can holder having a bottom that is drawn up within the space of the body portion such that the bottom edges thereof are generally coplanar with the bottom surface of the holder bottom to provide increased stabilized support from supporting surfaces the can holding insulated beverage holder may be placed on. This finished holder is storable in a collapsed flat state to be opened when receiving a beverage can or other beverage container to be held and insulated by the holder.

A specific embodiment representing what is presently regarded as the best mode of carrying out the invention is illustrated in the accompanying drawings.

Figure 2:
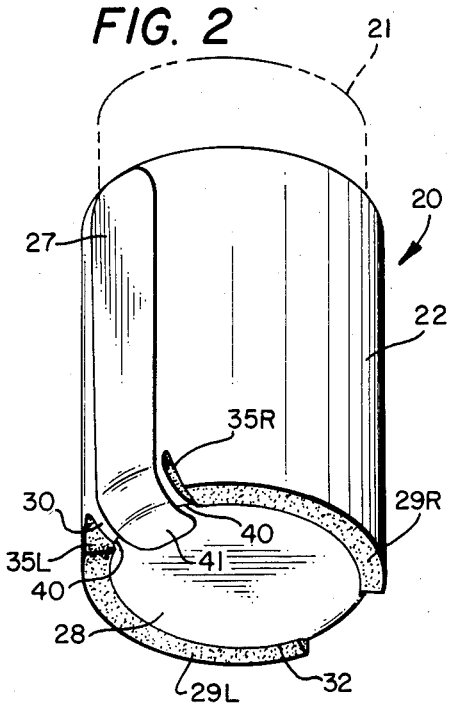
Figure 3:
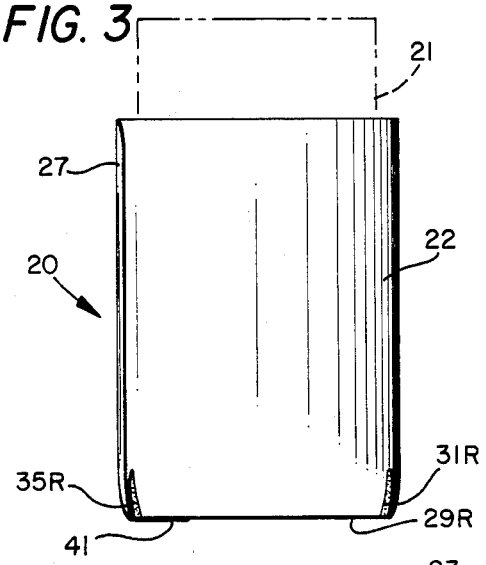
Figure 4:
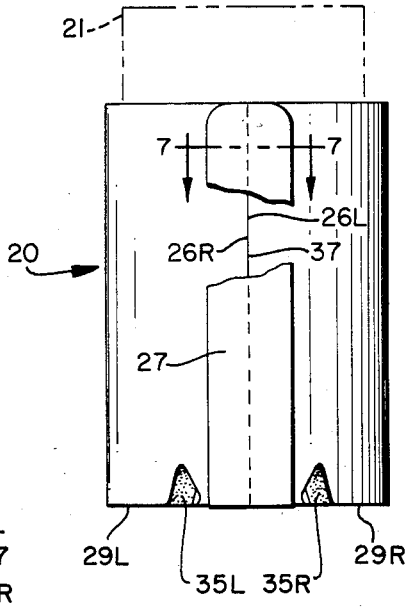
Figure 5:
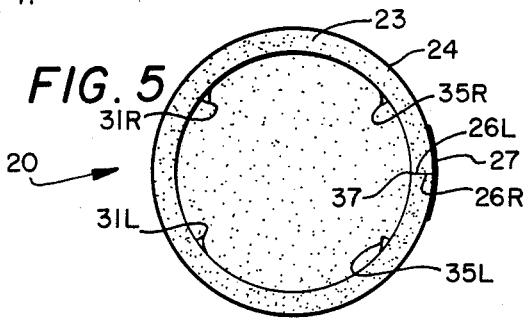
Figure 6:
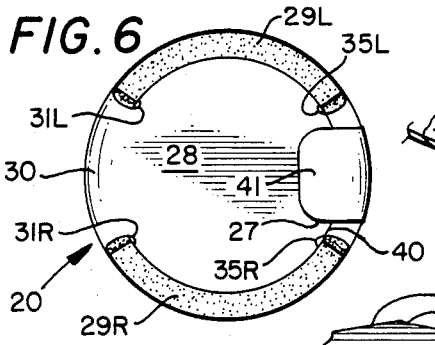
Figure 7:
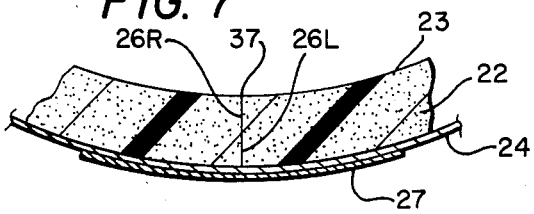
Figure 8:
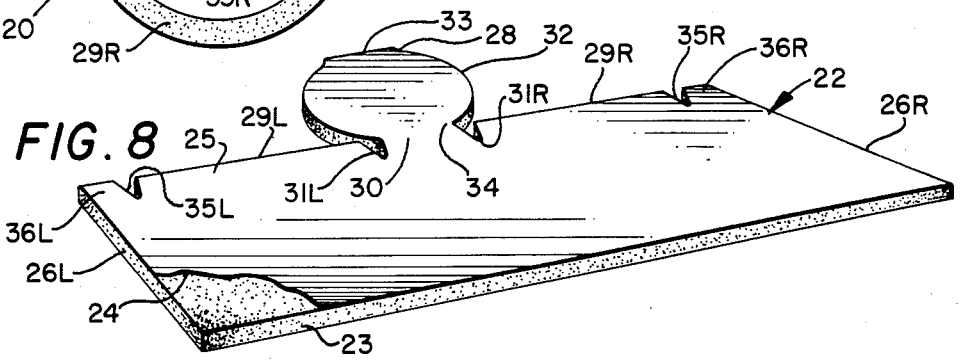
Figure 9:
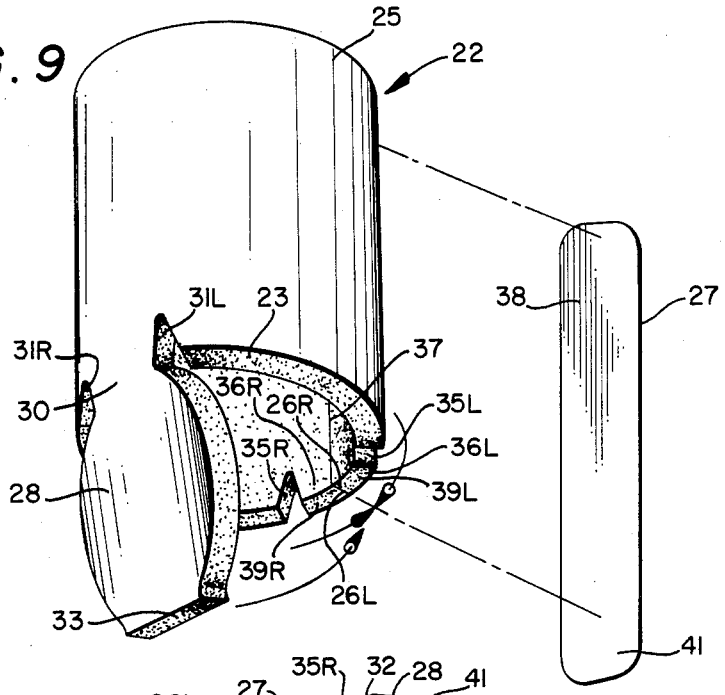
Figure 10:
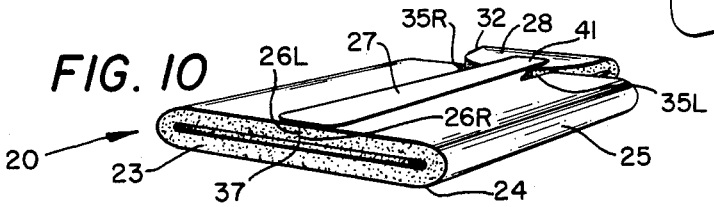

In the drawings:

FIG. 1 represents a top perspective view of the improved insulated beverage container holder;

FIG. 2, a bottom perspective view thereof;

FIG. 3, a side elevation of the holder from one side;

FIG. 4, a partially broken away side elevation of the holder showing joined edges and a joining tape overlapping the adjoining edges;

FIG. 5, a top plan view of the holder;

FIG. 6, a bottom plan view of the holder;

FIG. 7, a partial cut away and sectioned view showing the joined edges of the body of the holder taken along line 7—7 of FIG. 4;

FIG. 8, a perspective view of the flat die cut sheet holder form of one side vinyl laminated insulative foam;

FIG. 9, a construction detail perspective view of the holder form in a pre-completion state with the main body edges almost together and the bottom ready to fold up for the connective tape to fasten it together in the finished state; and FIG. 10, the insulative holder in the collapsed storage state from the can carrying state of FIGS. 1–6.

Referring to the drawings:

The fold-up insulator holder 20 for holding beverage containers 21 is shown in the container 21 holding state in FIGS. 1–6. The holder 20 is made from a sheet 22 of insulative foam 23 (closed cell or open cell) with a smooth laminated outer surface of vinyl 24. Referring also to FIG. 7 the holder 20 is formed from the sheet 22 with a main body portion 25 having two opposite side edges 26L and 26R joined together by seam tape 27. The holder 20 is formed with the main body portion 25 die cut as shown in FIG. 8 with a bottom projection 28 extending beyond bottom edges 29L and 29R of the main body portion 25. The bottom projection 28 includes an interconnect shank 30 between two opposite side cutouts 31L and 31R die cut into the main body portion. A generally rounded disk like portion 32, part of the bottom projection 28 on interconnect shank 30, has a flat edge surface 33 on the opposite side from the shank 30 that is of the same transverse length as the length of the shank 30 to disk like portion junction 34 in line with body portion bottom edges 29L and 29R. Toward the outer edges 26L and 26R of the main body portion 25 there are two additional cutouts 35L and 35R duplicating the two cutouts 31L and 31R leaving two mirror image tabs 36L and 36R that are substantially the same length as all the cutouts 31L, 31R, 35L and 35R, the shank 30 and the thickness of the main body portion 25 and the bottom rounded disk like portion 32 as well.

Referring also to FIG. 9 the fold-up insulator beverage container holder 20 is formed from the die cut form of FIG. 8 to the finished form by drawing opposite side edges 26L and 26R together forming seam 37 held together by an adhesive 38 surfaced vinyl tape 27. Then the mirror image tabs 36L and 36R are pressed over to form with end surfaces 39L and 39R a seam 40 with flat edge surface 33 on disk like portion 32 with the disk portion 32 bent over to bring flat edge surface 33 into engagement with tab end surfaces 39L and 39R all held together with vinyl tape 27 lower end 41 adhesively in place bent thereover. Thereafter the beverage container 21 insulator holder 20 can be used in the can holding state of FIGS. 1–6 or folded to the flat storage state of FIG. 10.

Whereas this invention has been described with respect to a single embodiment thereof, it should be realized that various changes may be made without departure from the essential contributions to the art made by the teachings hereof.

I claim:

1. A fold-up insulative beverage container holder with an open top and a stabilizing support base comprising: a sheet form of insulative material with a substantially rectangular body portion that when transverse ends thereof are fastened together and a cylindrical beverage container is held thereby assumes the shape of a cylinder; a bottom projection from the rectangular body portion that when assembled in the finished holder forms a center bottom portion fastened at two opposite sides to said rectangular body portion that is collapsible from the cylindrical state to a flattened state when a beverage container is removed from said holder; and with said center bottom portion sized and connected to said rectangular body portion to be drawn to a position within said rectangular body portion as it assumes a cylindrical shape with insertion of a cylindrical beverage container therein such that bottom edge surface means of said rectangular body portion derive stabilizing support from any planar support surface the holder holding a beverage container is placed on; wherein said sheet form of insulative material is a die cut sheet of insulative material that is a one sided smooth plastic surface laminated sheet of insulative foam; the one sided smooth plastic surface of said die cut sheet form of insulative material is to the outside of said insulative beverage container holder; said one sided smooth plastic surface is a vinyl laminated surface on said sheet form of insulative material; said foam faces the inside of said holder and said smooth outer plastic surface is a media for printing; where the transverse ends of said rectangular body portion are held together as a seam by a seam tape; said bottom projection from said rectangular body portion includes, an interconnect shank positioned between two opposite side cutouts in said rectangular body portion; and a generally rounded disk like portion approximately the size and area of a beverage container the holder is designed to hold; and wherein said rectangular body portion also includes two additional cutouts near the transverse ends ends of said rectangular body portion defining two mirror image tabs that together when said transverse ends of said rectangular body portion are held together form a connective counterpart of said shank connectable to the opposite side of said generally rounded disk like portion from the connection thereof to said shank.

2. The fold-up insulative beverage container holder of claim 1, wherein said generally rounded disk like portion is formed with a flat edge surface on the opposite side thereof for connection to the ends of said mirror image tabs.

3. The fold-up insulative beverage container holder of claim 2, wherein said seam tape extends from said rectangular body portion down over said mirror image tabs and on over part of the outside bottom of said generally disk like portion.

4. The fold-up insulative beverage container holder of claim 3, wherein said cutouts are all substantially the same length.

5. The fold-up insulative beverage container holder of claim 4, wherein said cutouts are at least as deep as the thickness of said rectangular body portion in order that said generally rounded disk like portion be drawn up within the bottom space of said body portion when the holder assumes the shape of a cylinder with the bottom surface of the holder bottom being generally coplanar with the bottom edge surfaces of said rectangular body portion.

6. A fold-up insulative beverage container holder with an open top and a stabilizing support base comprising; a sheet form of insulative material with a substantially rectangular body portion that when transverse ends thereof are fastened together and a cylindrical beverage container is held thereby assumes the shape of a cylinder; a bottom projection from the rectangular body portion that when assembled in the finished holder forms a center bottom portion fastened at two opposite sides to said rectangular body portion that is collapsible from the cylindrical state to a flattened state when a beverage container is removed from said holder; and with said center bottom portion sized and connected to said rectangular body portion to be drawn to a position within said rectangular body portion as it assumes a cylindrical shape with insertion of a cylindrical beverage container therein such that bottom edge surface means of said rectangular body portion derive stabilizing support from any planar support surface the holder holding a beverage container is placed on; where the transverse ends of said rectangular body portion are held together as a seam by a seam tape; wherein said bottom projection from said rectangular body portion includes, an interconnect shank positioned between two opposite side cutouts in said rectangular body portion; and a generally rounded disk like portion approximately the size and area of a beverage container the holder is designed to hold; and wherein said rectangular body portion also includes two additional cutouts near the transverse ends of said rectangular body portion defining two mirror image tabs that together when said transverse ends of said recatngular body portion are held together form a connective counterpart of said shank connectable to the opposite side of said generally rounded disk like portion from the connection thereof to said shank.

7. The fold-up insulative beverage container holder of claim 6, wherein said generally rounded disk like portion is formed with a flat edge surface on the opposite side thereof for connection to the ends of said mirror image tabs.

8. The fold-up insulative beverage container holder of claim 7, wherein said seam tape extends from said rectangular body portion down over said mirror image tabs and on over part of the outside bottom of said generally rounded disk like portion.

9. The fold-up insulative beverage container holder of claim 8, wherein said cutouts are all substantially the same length.

10. The fold-up insulative beverage container holder of claim 9, wherein said cutouts are at least as deep as the thickness of said rectangular body portion in order that said generally rounded disk like portion be drawn up within the bottom space of said body portion when the holder assumes the shape of a cylinder with the bottom surface of the holder bottom being generally coplanar with the bottom edge surfaces of said rectangular body portion.

* * * * *